US011201416B2

(12) United States Patent
Hashiguchi

(10) Patent No.: US 11,201,416 B2
(45) **Date of Patent: *Dec. 14, 2021**

(54) ANTENNA AND PARTLY FINISHED PRODUCT OF FACING PORTION USED IN THE SAME

(71) Applicant: JAPAN AVIATION ELECTRONICS INDUSTRY, LIMITED, Tokyo (JP)

(72) Inventor: Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/848,911

(22) Filed: Apr. 15, 2020

(65) Prior Publication Data

US 2020/0412024 A1 Dec. 31, 2020

(30) Foreign Application Priority Data

Jun. 27, 2019 (JP) ..... JP2019-119571

(51) Int. Cl.
*H01Q 1/38* (2006.01)
*H01Q 23/00* (2006.01)

(52) U.S. Cl.
CPC ..... *H01Q 23/00* (2013.01)

(58) Field of Classification Search
CPC .. H01Q 1/36; H01Q 1/38; H01Q 1/50; H01Q 1/243; H01Q 21/065; H01Q 21/08
See application file for complete search history.

(56) References Cited

U.S. PATENT DOCUMENTS

| | | | | |
|---|---|---|---|---|
| 7,113,143 | B2 | 9/2006 | Minemura | |
| 9,203,154 | B2 * | 12/2015 | Korva | H01Q 5/378 |
| 9,502,761 | B2 | 11/2016 | Itoh et al. | |
| 10,211,541 | B2 | 2/2019 | Sano et al. | |
| 2002/0021249 | A1 | 2/2002 | Kuck | |
| 2006/0001575 | A1 | 1/2006 | Jo et al. | |

(Continued)

FOREIGN PATENT DOCUMENTS

| | | | |
|---|---|---|---|
| JP | 2005203854 | A | 7/2005 |
| JP | 2016225956 | A | 12/2016 |

(Continued)

OTHER PUBLICATIONS

Extended European Search Report (EESR) dated Sep. 16, 2020 issued in European Application No. 20159316.7.

(Continued)

*Primary Examiner* — Tung X Le
(74) *Attorney, Agent, or Firm* — Holtz, Holtz & Volek PC

(57) ABSTRACT

An antenna has an antenna main portion formed on a substrate and a facing portion separate and distinct from the substrate. The antenna main portion has a ring shape with a split and has a first end portion and a second end portion which form the split. The facing portion has a first facing portion and a second facing portion which are made of insulating material and apart from each other. The first facing portion has a first principal portion and a first connected portion connected to the first end portion. The second facing portion has a second principal portion facing the first principal portion and a second connected portion connected to the second end portion.

8 Claims, 8 Drawing Sheets

(56) References Cited

U.S. PATENT DOCUMENTS

| | | | | |
|---|---|---|---|---|
| 2007/0176827 | A1* | 8/2007 | Itoh | H01Q 21/08 343/700 MS |
| 2009/0027275 | A1 | 1/2009 | Su et al. | |
| 2010/0265146 | A1* | 10/2010 | Montgomery | H01Q 1/38 343/722 |
| 2011/0109510 | A1* | 5/2011 | Onaka | H01Q 9/42 343/700 MS |
| 2011/0128187 | A1* | 6/2011 | Ju | H01Q 9/0407 343/700 MS |
| 2012/0007782 | A1 | 1/2012 | Nishio et al. | |
| 2014/0203987 | A1 | 7/2014 | Itoh et al. | |
| 2015/0288071 | A1* | 10/2015 | Toyao | H01Q 5/328 343/700 MS |
| 2016/0294048 | A1 | 10/2016 | Xu et al. | |
| 2017/0117612 | A1 | 4/2017 | Toyao et al. | |
| 2018/0351231 | A1 | 12/2018 | Sarkis et al. | |
| 2019/0267968 | A1 | 8/2019 | Hamatani et al. | |
| 2020/0252042 | A1* | 8/2020 | Mori | H04B 1/18 |
| 2020/0335849 | A1 | 10/2020 | Hashiguchi | |
| 2020/0411975 | A1 | 12/2020 | Hashiguchi | |

FOREIGN PATENT DOCUMENTS

| | | | |
|---|---|---|---|
| JP | 2018174585 | A | 11/2018 |
| JP | 2018537037 | A | 12/2018 |

OTHER PUBLICATIONS

Related U.S. Appl. No. 16/784,500, First Named Inventor: Osamu Hashiguchi; Title: "Antenna"; filed Feb. 7, 2020.

Related U.S. Appl. No. 16/848,898; First Named Inventor: Osamu Hashiguchi; Title: "Antenna"; filed Apr. 15, 2020.

Office Action (Non-Final Rejection) dated Aug. 19, 2021 issued in related U.S. Appl. No. 16/784,500.

Notice of Allowance dated Sep. 24, 2021 issued in related U.S. Appl. No. 16/848,898.

* cited by examiner

ANTENNA AND PARTLY FINISHED PRODUCT OF FACING PORTION USED IN THE SAME

CROSS REFERENCE TO RELATED APPLICATIONS

This application is based on and claims priority under 35 U.S.C. § 119 to Japanese Patent Application No. JP2019-119571 filed Jun. 27, 2019, the contents of which are incorporated herein in their entirety by reference.

BACKGROUND OF THE INVENTION

This invention relates to an antenna and a partly finished product of a facing portion used in the antenna, particularly, to an antenna having a main portion formed on a substrate and a facing portion separate and distinct from the substrate, and to a partly finished product of the facing portion.

JP2016-225956A (Patent Document 1) discloses an antenna having a split ring resonator structure. As shown in FIG. 16, an antenna 90 of Patent Document 1 has a dielectric layer 910, a conductor layer 920 formed on one of a pair of main surfaces of the dielectric layer 910, and a feeding line 930 formed on the other of the main surfaces of the dielectric layer 910. The conductor layer 920 is formed in a C-shape. Moreover, both end portions of the conductor layer 920 are apart from each other and face each other to form a facing portion 940 which operates as a capacitor. The conductor layer 920 and the feeding line 930 are connected to each other by use of a via 950 which passes through the dielectric layer 910. In detail, the via 950 connects an end portion of the feeding line 930 to the vicinity of one of the end portions of the conductor layer 920.

SUMMARY OF THE INVENTION

The antenna of Patent Document 1 is produced using a printed substrate. When the antenna produced using the printed substrate does not obtain desired characteristics due to manufacture variations or the like, it is necessary to further add a matching circuit, such as an inductor, a capacitor and so on, to the already-produced antenna or remake the substrate as such. Accordingly, the antenna of Patent Document 1 has a problem that it is difficult to adjust variations of antenna characteristics.

It is therefore an object of the present invention to provide an antenna which is provided with a discrete part separate and distinct from a substrate as a facing portion so as to adjust variations of antenna characteristics easily.

First aspect of the present invention provides an antenna having an antenna main portion formed on a substrate and a facing portion separate and distinct from the substrate. The antenna main portion has a ring shape with a split and has a first end portion and a second end portion which are located apart from each other in a lateral direction parallel with the substrate to form the split. The facing portion has a first facing portion and a second facing portion which are made of conductive material and apart from each other. The first facing portion has a first principal portion and a first connected portion which extends from the first principal portion and which is connected to the first end portion. The second facing portion has a second principal portion facing the first principal portion and a second connected portion which extends from the second principal portion and which is connected to the second end portion.

Second aspect of the present invention provides a partly finished product of a facing portion forming a capacitor to be mounted on a substrate. The partly finished product is made of conductive material. The partly finished product has a facing portion and a joining portion. The facing portion has a first facing portion and a second facing portion which are apart from each other. The joining portion joins a first facing portion and a second facing portion to each other.

The antenna according to the first aspect of the present invention has the antenna main portion formed on the substrate and the facing portion separate and distinct from the substrate. Since the facing portion is separate and distinct from the substrate, antenna characteristics can be easily adjusted by replacement of the facing portion.

Moreover, in the partly finished product of the facing portion according to the second aspect of the present invention, the first facing portion and the second facing portion are joined to each other by the joining portion. Accordingly, it can be easily carried out to attach the partly finished product to the substrate. As a result, it can easily adjust antenna characteristics of an antenna produced using the partly finished product.

An appreciation of the objectives of the present invention and a more complete understanding of its structure may be had by studying the following description of the preferred embodiment and by referring to the accompanying drawings.

Figure 1:
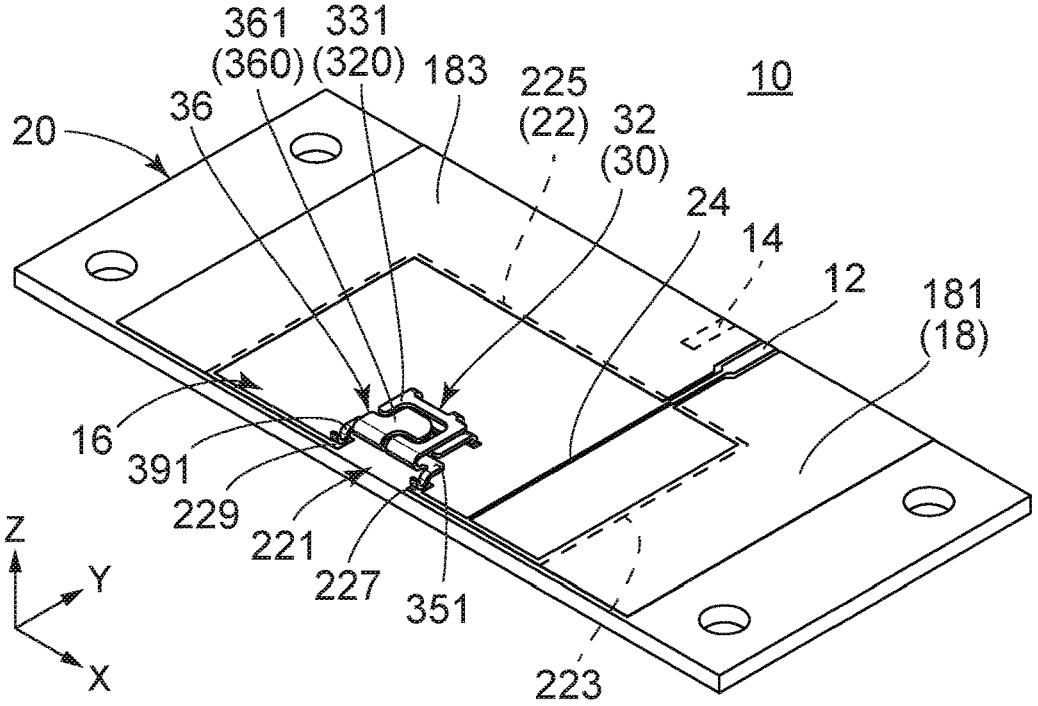
FIG. 1 is a perspective view showing an antenna according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Referring to FIG. 1, an antenna 10 according to a first embodiment of the present invention is provided with a first terminal 12, a second terminal 14, an LC resonator 16 connected to the first terminal 12 and a ground plane 18 connected to the LC resonator 16 and the second terminal 14. In the present embodiment, the LC resonator 16 has an antenna main portion 22 formed on a substrate 20 and a facing portion 30 mounted on the substrate 20. In other words, the antenna 10 is provided with the antenna main portion 22 united with the substrate 20 and the facing portion 30 as a discrete part separate and distinct from the substrate 20 in the present embodiment. In the present embodiment, the antenna main portion 22 works as an inductor (L), and the facing portion 30 works as a capacitor (C).

As understood from FIG. 1, the antenna main portion 22 has a ring shape with a split 221 when viewed along an up-down direction. In other words, the antenna main portion 22 has an angular C-shape in the present embodiment when viewed along the up-down direction. In the present embodiment, the up-down direction is a Z-direction perpendicular to the substrate 20. A positive Z-direction is directed upward while a negative Z-direction is directed to downward.

As shown in FIG. 1, the antenna main portion 22 has a first portion 223 and a second portion 225 which are formed on an upper surface of the substrate 20. The antenna main portion 22 further has one or more additional portions (not shown) formed in one or more conductive layers (not shown) of the substrate 20. Here, the conductive layers include inner conductive layers (not shown) formed in the substrate 20 and a lower conductive layer (not shown) formed on a lower surface of the substrate 20. The additional portions are formed to overlap with both of the first portion 223 and the second portion 225 viewed along the up-down direction. Moreover, the additional portions are electrically connected to the first portion 223 in the up-down direction, and they are also electrically connected to the second portion 225 in the up-down direction. With this structure, the first portion 223 of the antenna main portion 22 and the second portion 225 of the antenna main portion 22 are electrically connected to each other via the additional portions.

Figure 11:
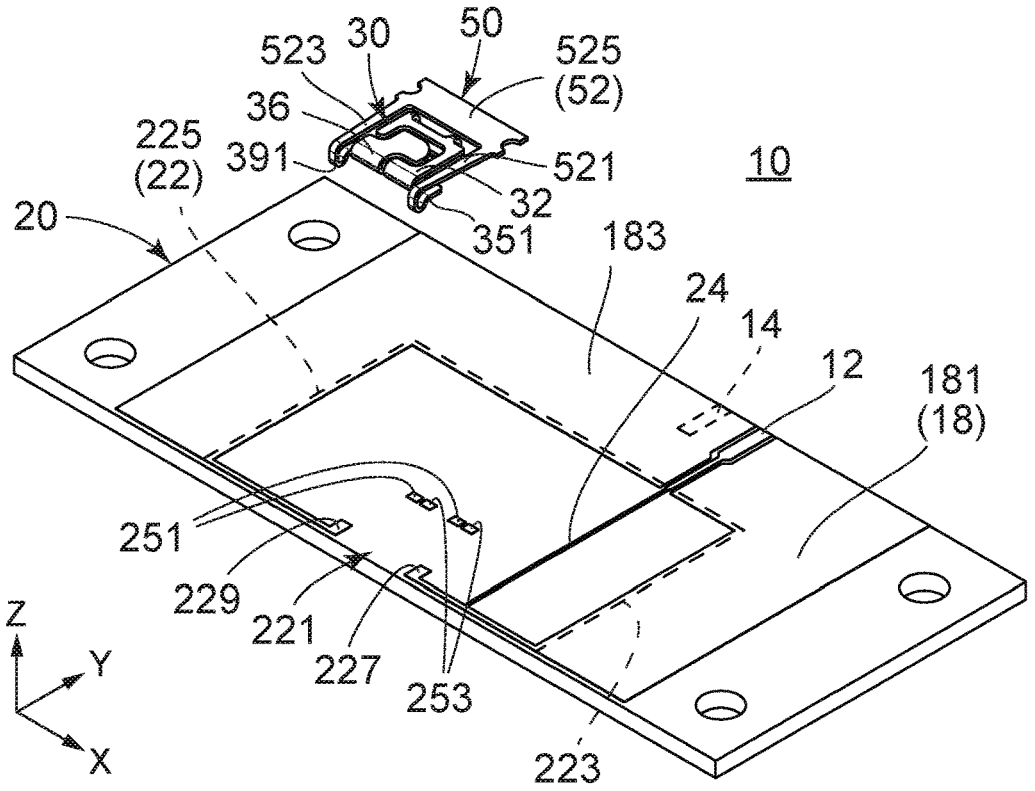
FIG. 11 is a perspective view showing one step in a manufacturing process for manufacturing the antenna of FIG. 1. The partly finished product of the facing portion is not mounted on a substrate yet.

As shown in FIGS. 1 and 11, the antenna main portion 22 has a first end portion 227 and a second end portion 229 which are located apart from each other in a lateral direction parallel with the substrate 20. The first end portion 227 and the second end portion 229 form the split 221 of the antenna main portion 22. The facing portion 30 is connected to the first end portion 227 and the second end portion 229. In the present embodiment, the lateral direction is an X-direction.

As understood from FIG. 1, the second terminal 14 and the ground plane 18 are integrally formed. In the present embodiment, the ground plane 18 has a first portion 181 and a second portion 183. The second terminal 14 is integrally formed with the second portion 183.

As shown in FIG. 1, the first portion 181 of the ground plane 18 is integrally formed with the first portion 223 of the antenna main portion 22. Moreover, the second portion 183 of the ground plane 18 is integrally formed with the second portion 225 of the antenna main portion 22. The first portion 181 of the ground plane 18 extends outward of the first portion 223 of the antenna main portion 22 in the lateral direction and extends rearward of the first portion 223 of the antenna main portion 22 in a front-rear direction. Moreover, the second portion 183 of the ground plane 18 extends outward of the second portion 225 of the antenna main portion 22 in the lateral direction and extends rearward of the second portion 225 of the antenna main portion 22 in the front-rear direction. The first portion 181 of the ground plane 18 and the second portion 183 of the ground plane 18 are electrically connected to each other via a subsidiary ground plane (not shown) formed in the inner conductive layer (not shown) of the substrate 20 or formed on the lower surface of the substrate 20. In the present embodiment, the front-rear direction is a Y-direction. A negative Y-direction is directed forward while a positive Y-direction is directed rearward.

As shown in FIG. 1, the first terminal 12 is connected to a feeding line 24. The feeding line 24 passes between the first portion 181 of the ground plane 18 and the second portion 183 of the ground plane 18 and between the first portion 223 of the antenna main portion 22 and the second portion 225 of the antenna main portion 22 to extend forward from the first terminal 12. In addition, the feeding line 24 is connected to the first portion 223 of the antenna main portion 22 in the vicinity of the first end portion 227 of the antenna main portion 22. Although the first terminal 12 and the feeding line 24 are formed on the upper surface of the substrate 20 in the present embodiment, the present invention is not limited thereto. The first terminal 12 and the feeding line 24 may be formed on the lower surface (not shown) of the substrate 20. In that case, the first portion 223 of the antenna main portion 22 and the second portion 225 of the antenna main portion 22 may be integrally formed. Similarly, the first portion 181 of the ground plane 18 and the second portion 183 of the ground plane 18 may be integrally formed.

Figure 2:
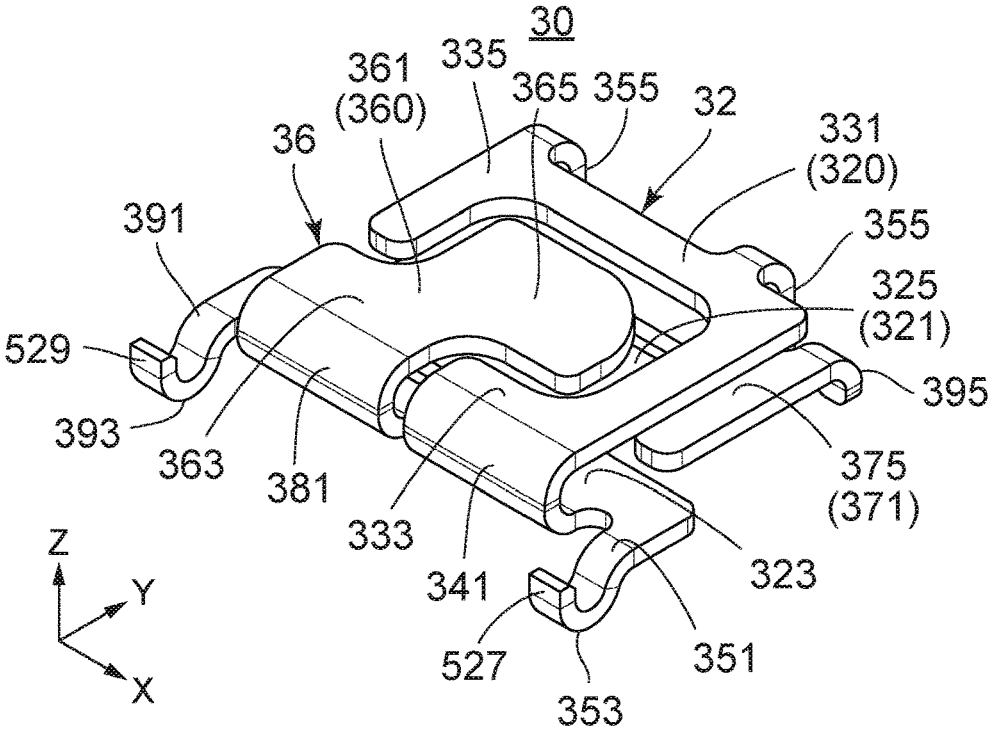
FIG. 2 is a perspective view showing a facing portion included in the antenna of FIG. 1.
Figure 8:
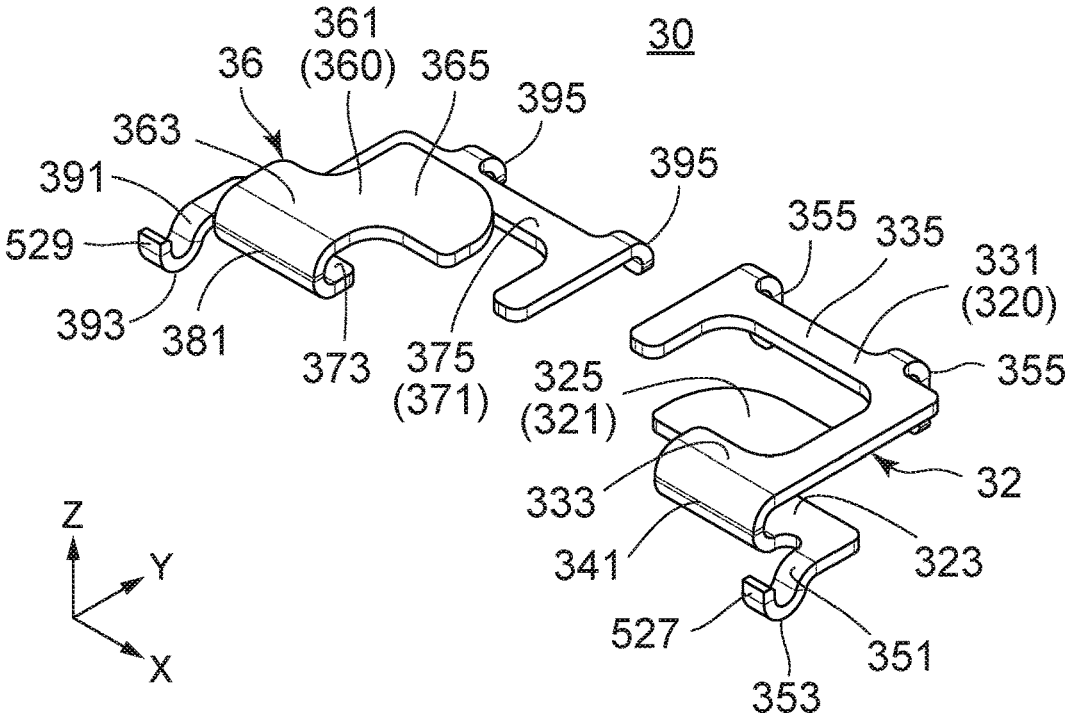
FIG. 8 is an exploded, perspective view showing the facing portion of FIG. 2.

Referring to FIG. 2, the facing portion 30 has a first facing portion 32 and a second facing portion 36. The first facing portion 32 and the second facing portion 36 are made of the same conductive material as each other. As understood from FIG. 8, the first facing portion 32 and the second facing portion 36 are separate and distinct from each other. Referring to FIGS. 1 and 8, the first facing portion 32 and the second facing portion 36 are mounted on the substrate 20 in a state that they are apart from each other.

Figure 3:
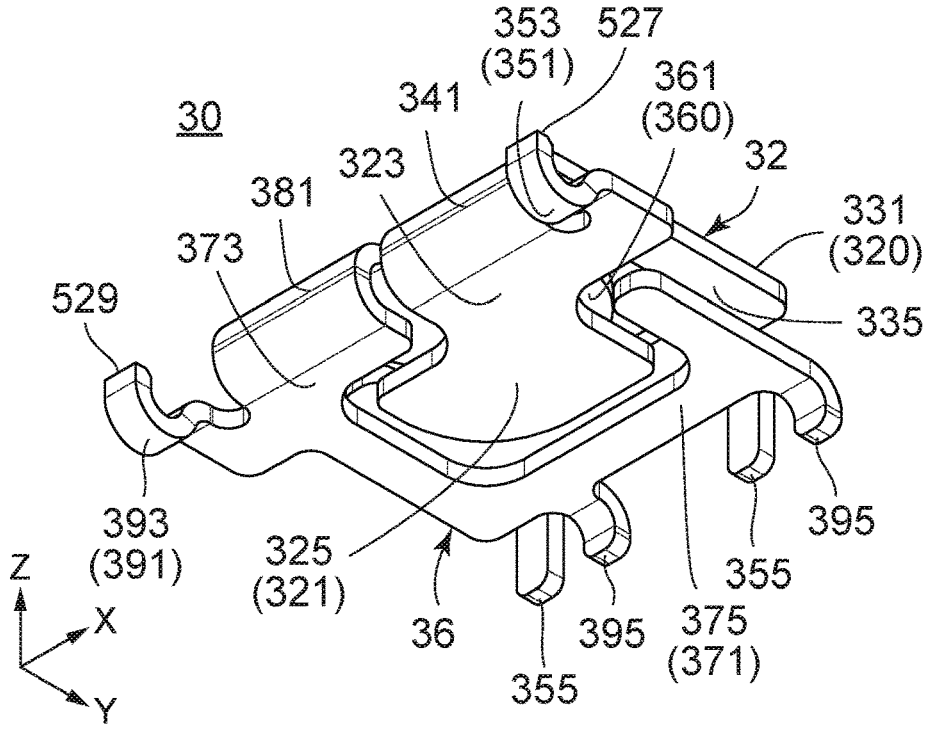
FIG. 3 is another perspective view showing the facing portion of FIG. 2.

As shown in FIGS. 2, 3 and 8, the first facing portion 32 has a first principal portion 320, a first connected portion 351 extending from the first principal portion 320 and a pair of first fixed portions 355 extending from the first principal portion 320.

As shown in FIGS. 2 to 5, the first principal portion 320 has a first middle plate portion 321, a first periphery plate portion 331 and a first bent portion 341 connecting the first middle plate portion 321 and the first periphery plate portion 331 to each other. The first middle plate portion 321 has a base portion 323 and a main body portion 325 extending diagonally rearward from the base portion 323. The first periphery plate portion 331 has a base portion 333 and an extension portion 335 extending from the base portion 333. The extension portion 335 extends rearward from the base portion 333 and then extends in the lateral direction, and further extends forward. The first bent portion 341 connects the base portion 323 of the first middle plate portion 321 and the base portion 333 of the first periphery plate portion 331 to each other in the up-down direction.

Figure 7:
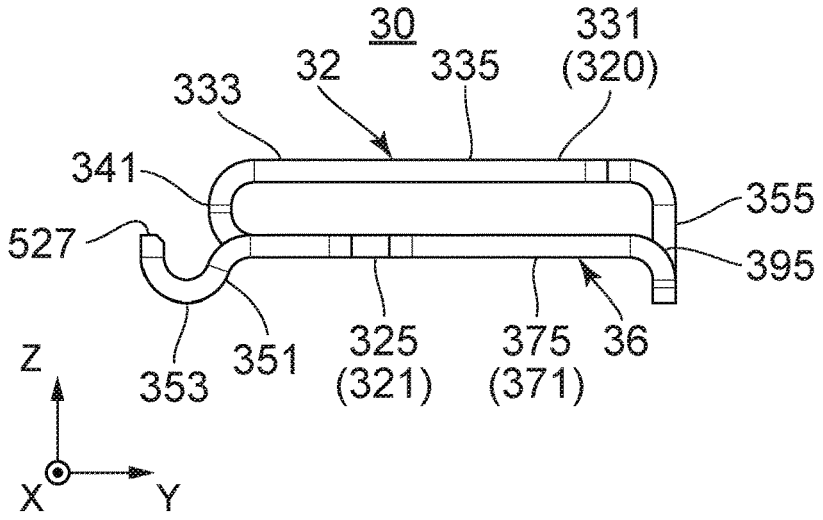
FIG. 7 is a right side view showing the facing portion of FIG. 2.

As understood from FIGS. 2, 3 and 7, the first middle plate portion 321 and the first periphery plate portion 331 are arranged so as to be perpendicular to the up-down direction, and they are located apart from each other in the up-down direction. In the present embodiment, the first middle plate portion 321 is located downward of the first periphery plate portion 331 in the up-down direction.

Figure 9:
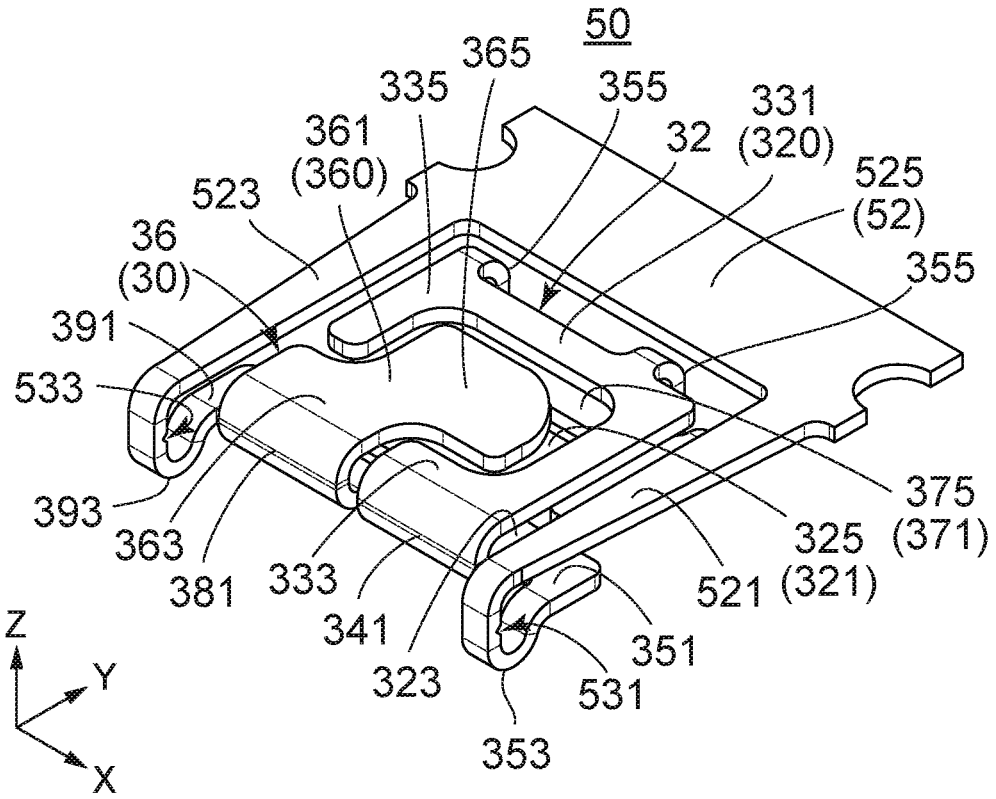
FIG. 9 is a perspective view showing a partly finished product of the facing portion of FIG. 2.

As shown in FIGS. 2 to 7, the first connected portion 351 extends outward in the lateral direction from the base portion 323 of the first middle plate portion 321 and then extends forward-diagonally downward, and further extends upward. With reference to FIGS. 2 and 9, in the present embodiment, at an end portion of the first connected portion 351, a first remaining portion 527 of a joining portion 52 mentioned later remains. The first remaining portion 527 extends upward from the end portion of the first connected portion 351.

As shown in FIGS. 2 to 7, each of the first fixed portions 355 extends rearward from a rear edge of the first periphery plate portion 331 and then extends downward.

As shown in FIGS. 2, 3 and 8, the second facing portion 36 has a second principal portion 360, a second connected portion 391 extending from the second principal portion 360 and a pair of second fixed portions 395 extending from the second principal portion 360.

As understood from FIGS. 2 to 5, the second principal portion 360 is the same as the first principal portion 320 turned upside down. In detail, the second principal portion 360 has a second middle plate portion 361, a second periphery plate portion 371 and a second bent portion 381 connecting the second middle plate portion 361 and the second periphery plate portion 371 to each other. The second middle plate portion 361 has a base portion 363 and a main body portion 365 extending diagonally rearward from the base portion 363. The second periphery plate portion 371 has a base portion 373 and an extension portion 375 extending from the base portion 373. The extension portion 375 extends rearward from the base portion 373 and then extends in the lateral direction, and further extends forward. The second bent portion 381 connects the base portion 363 of the second middle plate portion 361 and the base portion 373 of the second periphery plate portion 371 to each other in the up-down direction.

As understood from FIGS. 2, 3 and 7, the second middle plate portion 361 and the second periphery plate portion 371 are arranged so as to be perpendicular to the up-down direction, and they are located apart from each other in the up-down direction. In the present embodiment, the second middle plate portion 361 is located upward of the second periphery plate portion 371 in the up-down direction.

As shown in FIGS. 2 to 6, the second connected portion 391 extends outward in the lateral direction from the base portion 373 of the second periphery plate portion 371 and then extends forward-diagonally downward, and further extends upward. With reference to FIGS. 2 and 9, in the present embodiment, at an end portion of the second connected portion 391, a second remaining portion 529 of the joining portion 52 mentioned later remains. The second remaining portion 529 extends upward from the end portion of the second connected portion 391.

As shown in FIGS. 2 to 7, each of the second fixed portions 395 extends rearward from a rear edge of the second periphery plate portion 371 and then extends downward.

As understood from FIGS. 4 to 7, the first middle plate portion 321 and the second periphery plate portion 371 are coplanar with each other. Moreover, the first periphery plate portion 331 and the second middle plate portion 361 are coplanar with each other. As understood from FIGS. 4 and 5, when viewed along the up-down direction, the main body portion 325 of the first middle plate portion 321 and the main body portion 365 of the second middle plate portion 361 are roughly identical with each other. In addition, when viewed along the up-down direction, the extension portion 335 of the first periphery plate portion 331 and the extension portion 375 of the second periphery plate portion 371 are roughly identical with each other.

Figure 4:
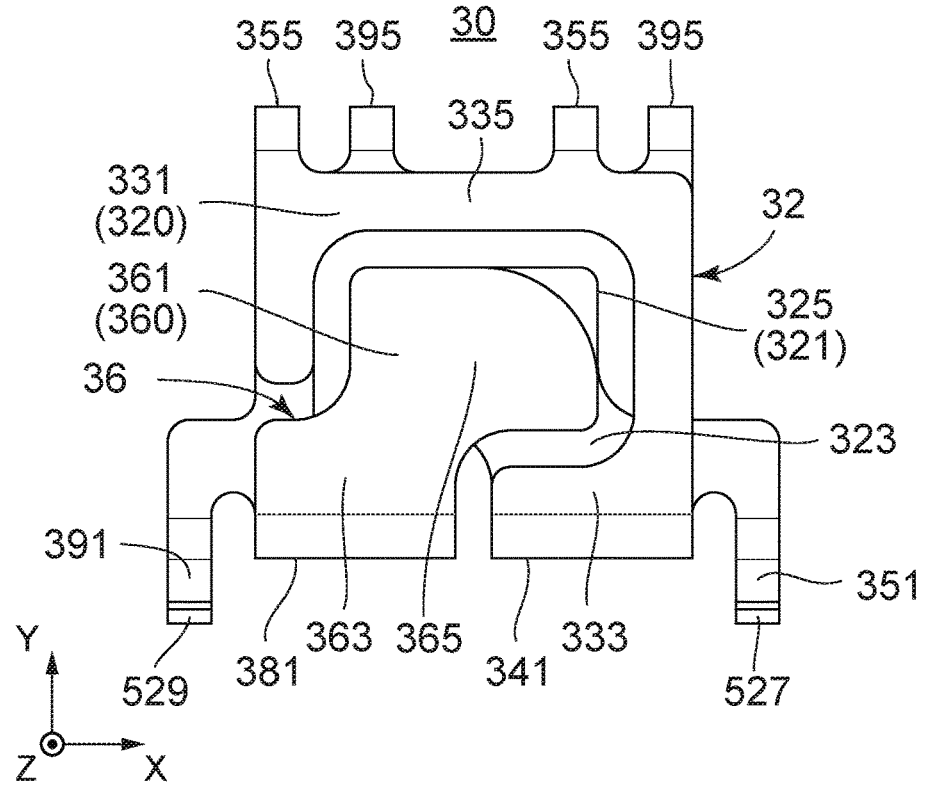
FIG. 4 is a plan view showing the facing portion of FIG. 2.
Figure 5:
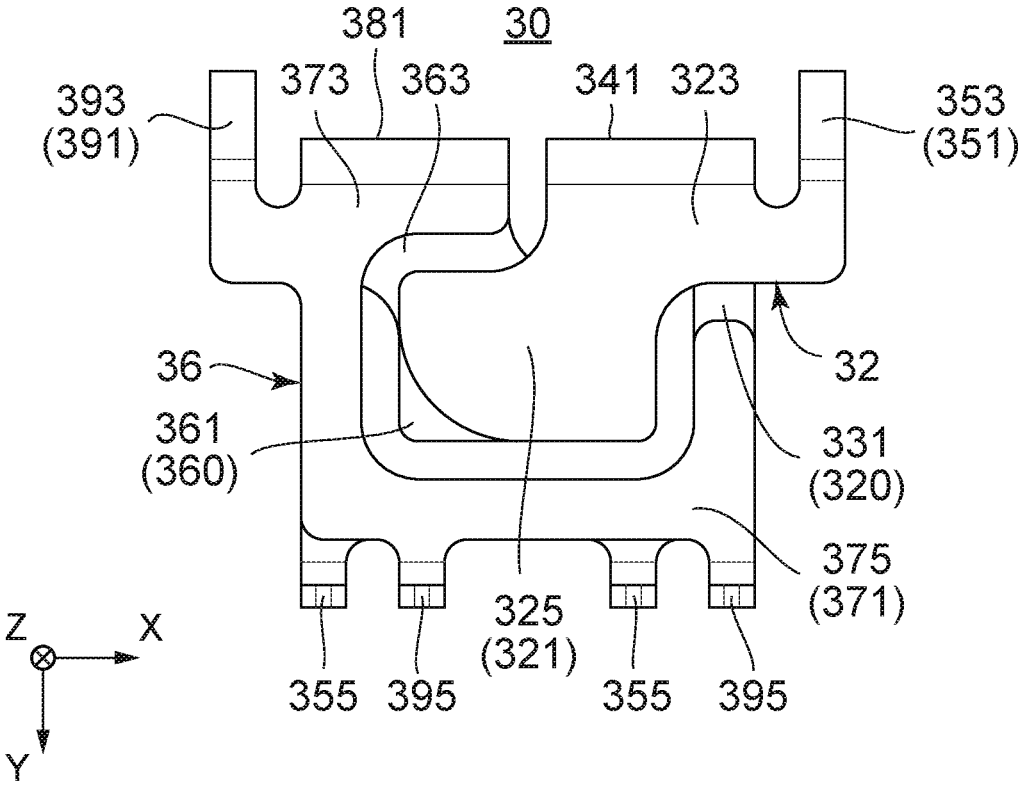
FIG. 5 is a bottom view showing the facing portion of FIG. 2.

As shown in FIG. 4, the first periphery plate portion 331 is apart from the second middle plate portion 361 and surrounds, but incompletely, the main body portion 365 of the second middle plate portion 361. Moreover, as shown in FIG. 5, the second periphery plate portion 371 is apart from the first middle plate portion 321 and surrounds, but incompletely, the main body portion 325 of the first middle plate portion 321. End faces of the first periphery plate portion 331 and end faces of the second middle plate portion 361 face one another in part, and end faces of the second periphery plate portion 371 and end faces of the first middle plate portion 321 face one another in part. In this way, the first principal portion 320 and the second principal portion 360 face each other to form a capacitor. However, the present invention is not limited thereto. Each of the first facing portion 32 and the second facing portion 36 may be freely modified in structure. For example, each of the first principal portion 320 and the second principal portion 360 may have a sing plate portion.

Figure 6:
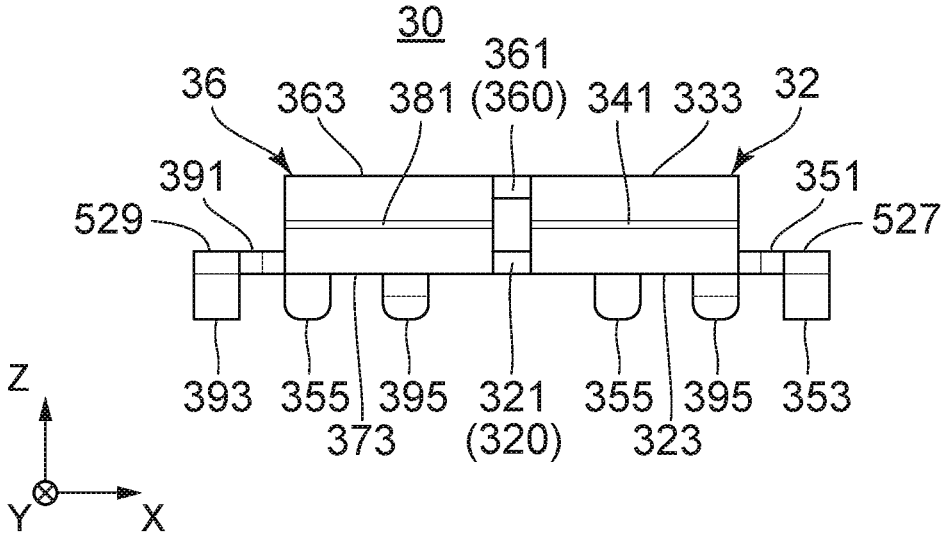
FIG. 6 is a front view showing the facing portion of FIG. 2.

As shown in FIG. 6, a lowermost portion of the first connected portion 351, a lowermost portion of the second connected portion 391, lower ends of the first fixed portions 355 and lower ends of the second fixed portions 395 are located at the same position as one another in the up-down direction. With this structure, mounting of the facing portion 30 to the substrate 20 can be carried out correctly. Additionally, the lowermost portion of the first connected portion 351 is a first connected part 353 to be connected to the first end portion 227 of the antenna main portion 22, and the lowermost portion of the second connected portion 391 is a second connected part 393 to be connected to the second end portion 229 of the antenna main portion 22.

As mentioned above, the first facing portion 32 and the second facing portion 36 are separate and distinct from each other (see FIG. 8). Accordingly, if the first facing portion 32 and the second facing portion 36 are used as they are, it is troublesome that they are mounted onto the substrate 20. Moreover, there is a possibility that characteristics of the antenna 10 are varied by change of a relative position between the first facing portion 32 and the second facing portion 36. Therefore, a partly finished product 50 of the facing portion 30 shown in FIG. 9 is used for mounting the first facing portion 32 and the second facing portion 36 onto the substrate 20.

As shown in FIG. 9, the partly finished product 50 of the facing portion 30 has the facing portion 30 and the joining portion 52. In detail, the partly finished product 50 has the first facing portion 32 and the second facing portion 36 which are apart from each other, and it further has the joining portion 52 joining the first facing portion 32 and the second facing portion 36 to each other. The first facing portion 32 and the second facing portion 36 are located at positions facing each other to form a capacitor. The joining portion 52 fixes the relative position between the first facing portion 32 and the second facing portion 36. The partly finished product 50 can be formed by cutting and bending a metal plate which is a conductive material.

As shown in FIG. 9, the joining portion 52 has a first extending portion 521, a second extending portion 523 and a flat plate portion 525. The first extending portion 521 extends from the first connected portion 351, and the second extending portion 523 extends from the second connected portion 391. Here, the first connected portion 351 is in between the first principal portion 320 and the first extending portion 521, and the second connected portion 391 is in between the second principal portion 360 and the second extending portion 523.

Figure 10:
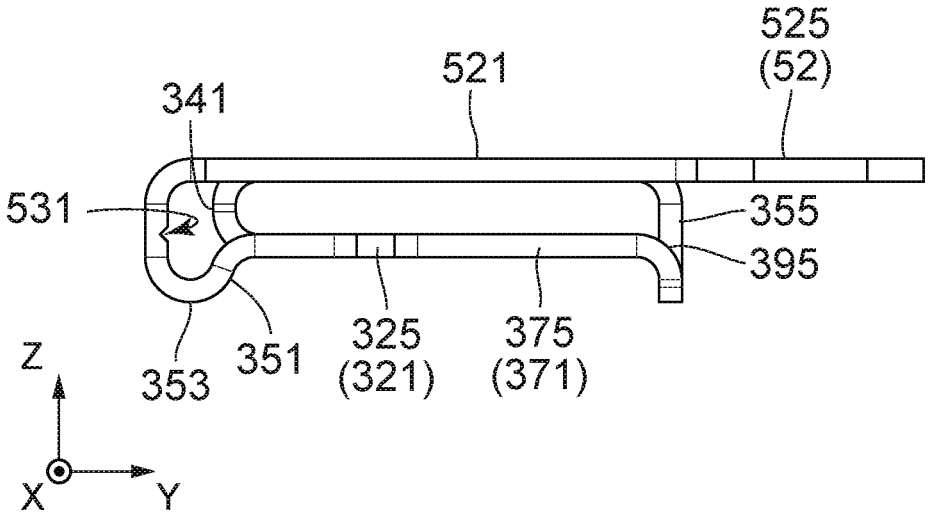
FIG. 10 is a right side view showing the partly finished product of FIG. 9.

As understood from FIGS. 9 and 10, the first extending portion 521 extends upward from the end portion of the first connected portion 351 and then extends rearward. The second extending portion 523 extends upward from the end portion of the second connected portion 391 and then extends rearward. The flat plate portion 525 extends in the lateral direction and connects the first extending portion 521 and the second extending portion 523 to each other. In the front-rear direction, the flat plate portion 525 is located rearward of the facing portion 30.

As understood from FIGS. 9 and 10, the joining portion 52 is coplanar with the first periphery plate portion 331 and the second middle plate portion 361 except for a part of the first extending portion 521 and a part of the second extending portion 523. Accordingly, in the up-down direction, a size of the partly finished product 50 is equal to a size of the facing portion 30.

As shown in FIGS. 9 and 10, the first extending portion 521 is formed with a first notch 531. The first notch 531 is located near the end portion of the first connected portion 351. A distance from the first notch 531 to the first connected part 353 is shorter than a distance from the first principal portion 320 to the first connected part 353. The first notch 531 opens rearward in the front-rear direction. Similarly, the second connected portion 391 is formed with a second notch 533. The second notch 533 is located near the end portion of the second connected portion 391. A distance from the second notch 533 to the second connected part 393 is shorter than a distance from the second principal portion 360 to the second connected part 393. The second notch 533 opens rearward in the front-rear direction.

Figure 12:
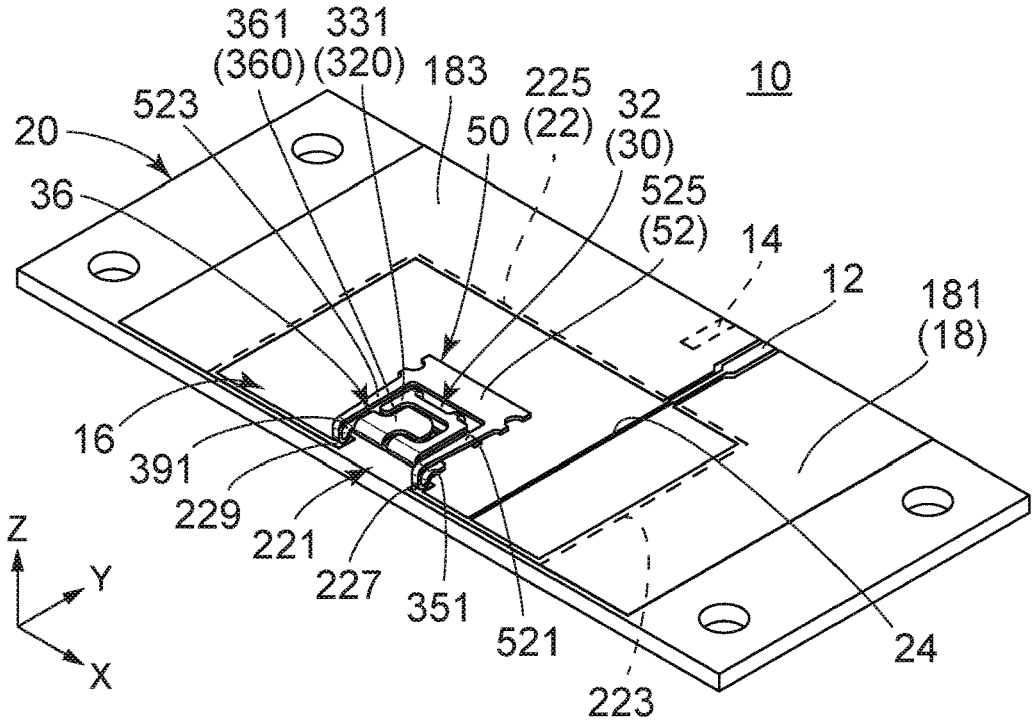
FIG. 12 is a perspective view showing a step following the step of FIG. 11. The partly finished product of the facing portion is mounted on an upper surface of the substrate.

As understood from FIGS. 11 and 12, in a manufacturing process of the antenna 10, the partly finished product 50 of the facing portion 30 is mounted on the substrate 20. The flat plate portion 525 of the joining portion 52 is used for suction and conveyance of the partly finished product 50 above the substrate 20. In other words, the flat plate portion 525 can be used as a sucked portion to be sucked by a suction nozzle (not shown).

As shown in FIG. 11, the upper surface of the substrate 20 is formed with a pair of first fixing portions 251 and a pair of second fixing portions 253 other than the first end portion 227 of the antenna main portion 22 and the second end portion 229 of the antenna main portion 22. Referring to FIGS. 9 and 11, the first connected portion 351 of the first facing portion 32 is connected to the first end portion 227 at the first connected part 353 thereof. Moreover, the second connected portion 391 of the second facing portion 36 is connected to the second end portion 229 at the second connected part 393 thereof. The first fixed portions 355 of the first facing portion 32 are connected to the first fixing portions 251 at the lower ends of them, respectively. Referring to FIGS. 10 and 11, the second fixed portions 395 of the second facing portion 36 are connected to the second fixing portions 253 at the lower ends of them, respectively.

As understood from FIG. 12 and FIG. 1, after the partly finished product 50 is mounted on the substrate 20, the flat plate portion 525 is cut off from the facing portion 30. In detail, the flat plate portion 525 is cut off from the facing portion 30 at the first extending portion 521 and the second extending portion 523. By cutting off the flat plate portion 525, the first facing portion 32 of the facing portion 30 and the second facing portion 36 of the facing portion 30 are separated from each other. Cutting off the flat plate portion 525 can be easily carried out by use of the first notch 531 and the second notch 533. In detail, the first extending portion 521 and the second extending portion 523 are snapped off and cut at the first notch 531 and the second notch 533 by applying a force on the flat plate portion 525 upward and forward. Since the first notch 531 and the second notch 533 are located near the first connected part 353 and the second connected part 393, respectively, the first extending portion 521 and the second extending portion 523 can be cut almost without causing deformation to the first connected portion 351 and the second connected portion 391. Accordingly, elimination of the flat plate portion 525 does not cause variations of the characteristics of the antenna 10. Additionally, a part of the first extending portion 521 and a part of the second extending portion 523 remain on the first facing portion 32 and the second facing portion 36 as the first remaining portion 527 and the second remaining portion 529, respectively. On an end portion of the first remaining portion 527 and an end portion of the second remaining portion 529, snapped marks formed by snapping off the flat plate portion 525 remain.

Thus, the antenna 10 shown in FIG. 1 is finished. According to the present embodiment, by use of the partly finished product 50, the facing portion 30 having the first facing portion 32 and the second facing portion 36 can be handled as a single part and easily mounted on the substrate 20. Moreover, the relative position between the first facing portion 32 and the second facing portion 36 are not changed when the first facing portion 32 and the second facing portion 36 are mounted on the substrate 20. Accordingly, variations of the characteristics of the antenna 10 depending on variations of the relative position between the first facing portion 32 and the second facing portion 36 are not caused. Furthermore, since the facing portion 30 can be easily handled, the facing portion 30 can be easily replaced, and thereby the variations of the characteristics of the antenna 10 can be easily adjusted.

Second Embodiment

Figure 13:
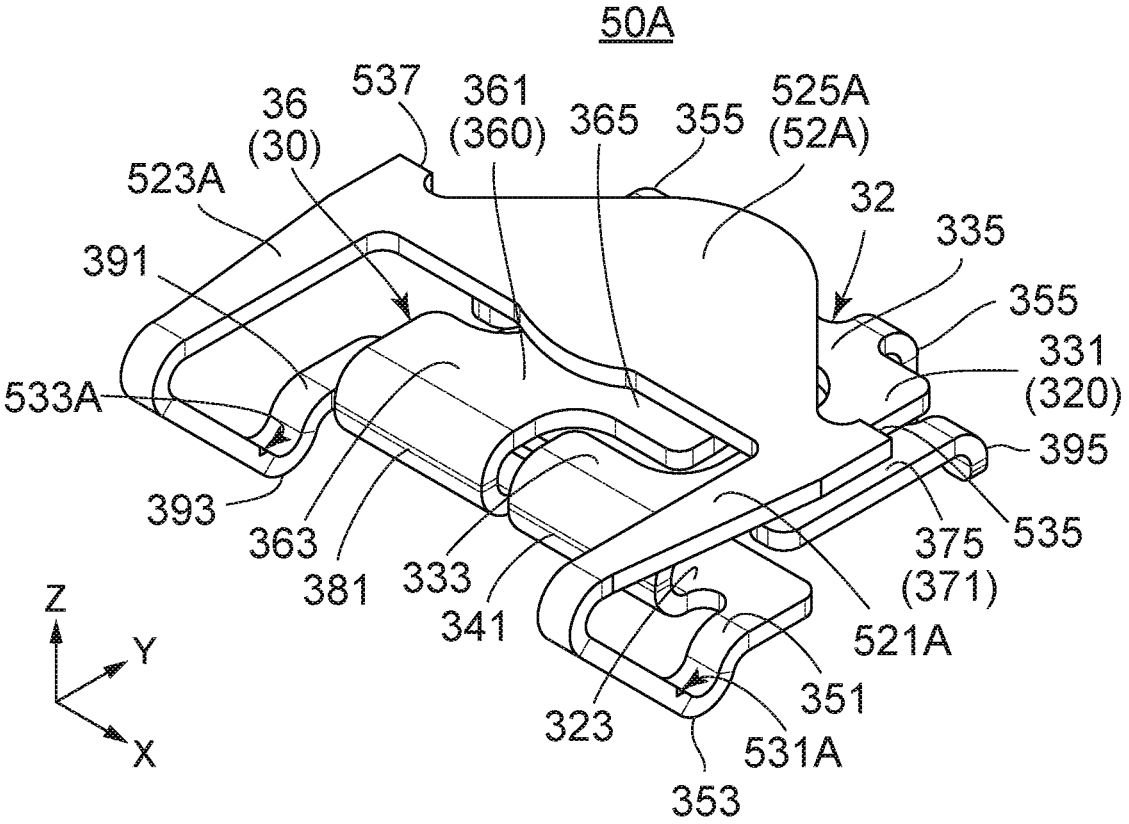
FIG. 13 is a perspective view showing a partly finished product of a facing portion included in an antenna according to a second embodiment of the present invention.

Referring to FIG. 13, a partly finished product 50A of a facing portion 30 according to a second embodiment of the present invention has the facing portion 30 and a joining portion 52A. As understood from FIGS. 9 and 13, the joining portion 52A is different in shape from the joining portion 52 of the partly finished product 50 in the first embodiment.

Figure 14:
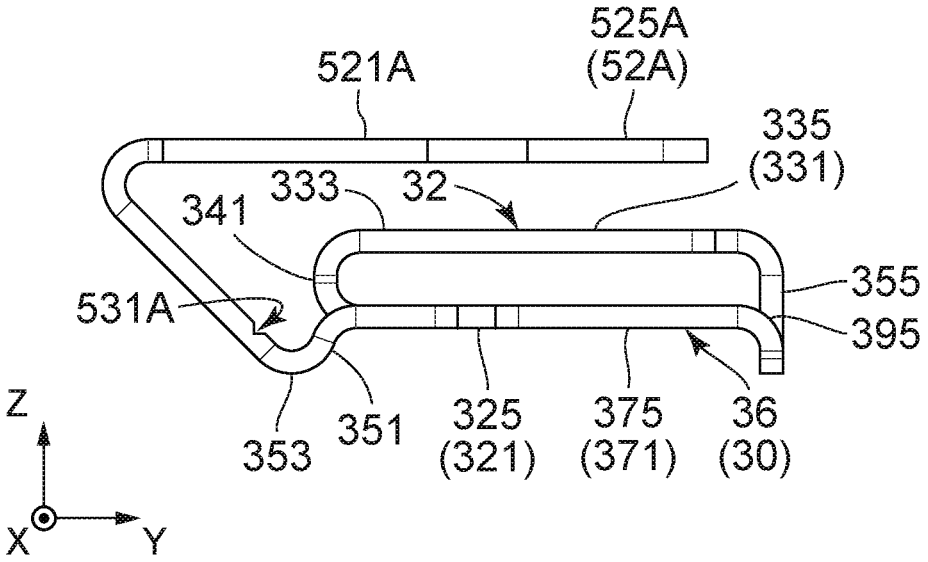
FIG. 14 is a right side view showing the partly finished product of FIG. 13.

As shown in FIGS. 13 and 14, the joining portion 52A has a first extending portion 521A, a second extending portion 523A and a flat plate portion 525A. The first extending portion 521A extends forward-diagonally upward from a first connected portion 351 and then extends rearward. The second extending portion 523A extends forward-diagonally upward from a second connected portion 391 and then extends rearward. The flat plate portion 525A extends in the lateral direction and connects the first extending portion 521A and the second extending portion 523A to each other.

As shown in FIG. 14, the flat plate portion 525A is located upward of the facing portion 30 in the up-down direction. As understood from FIGS. 13 and 14, the flat plate portion 525A is arranged so as to be parallel with the first principal portion 320 and the second principal portion 360. In detail, the flat plate portion 525A is arranged so as to be parallel with a first middle plate portion 321 of a first principal portion 320, a first periphery plate portion 331 of the first principal portion 320, a second middle plate portion 361 of a second principal portion 360 and a second periphery plate portion 371 of the second principal portion 360.

As shown in FIG. 13, a size of the flat plate portion 525A in the front-rear direction is large at the middle of the flat plate portion 525A in the lateral direction but small at both ends of the flat plate portion 525A in the lateral direction. This shape of the flat plate portion 525A is suitable for being sucked by a suction nozzle (not shown). Moreover, the flat plate portion 525A is formed to include a position corresponding to a center of gravity of the partly finished product 50A in a horizontal plane parallel with the first principal portion 320 and the second principal portion 360. In other words, when viewed along the up-down direction, the center of gravity of the partly finished product 50A is within an area occupied by the flat plate portion 525A. With this structure, when the flat plate portion 525A is sucked and conveyed by the suction nozzle, the partly finished product 50A can be stably conveyed.

Figure 15:
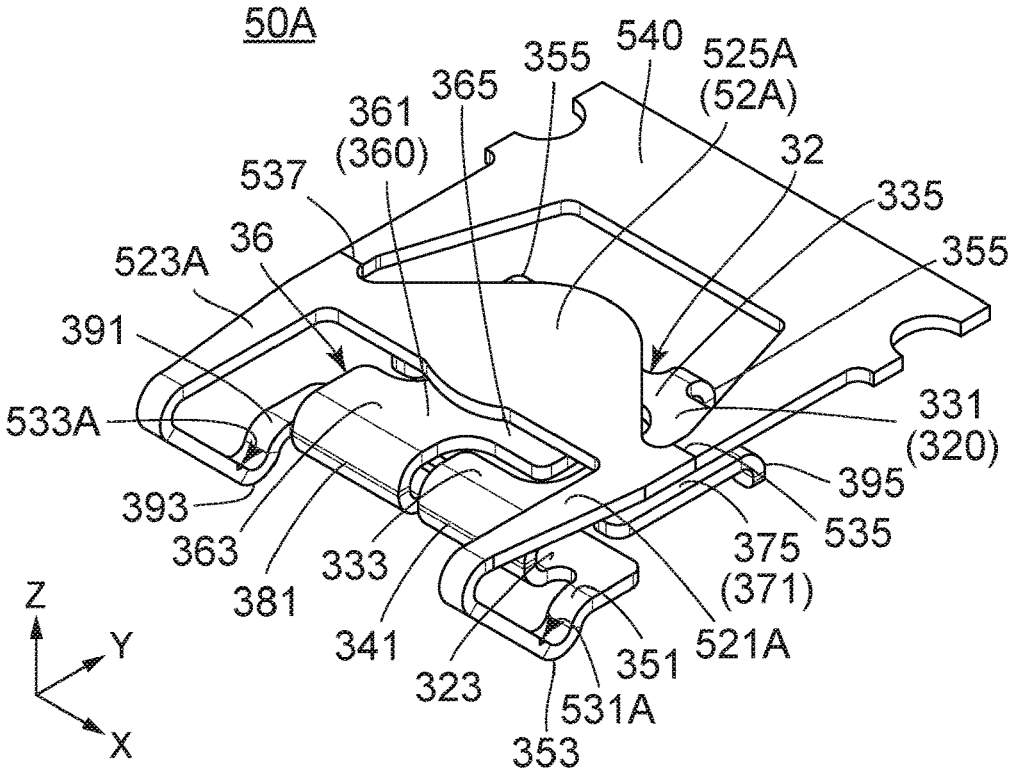
FIG. 15 is a perspective view showing a state in which the partly finished product of FIG. 13 is in the middle of production. The partly finished product is not cut off from a carrier yet.
Figure 16:
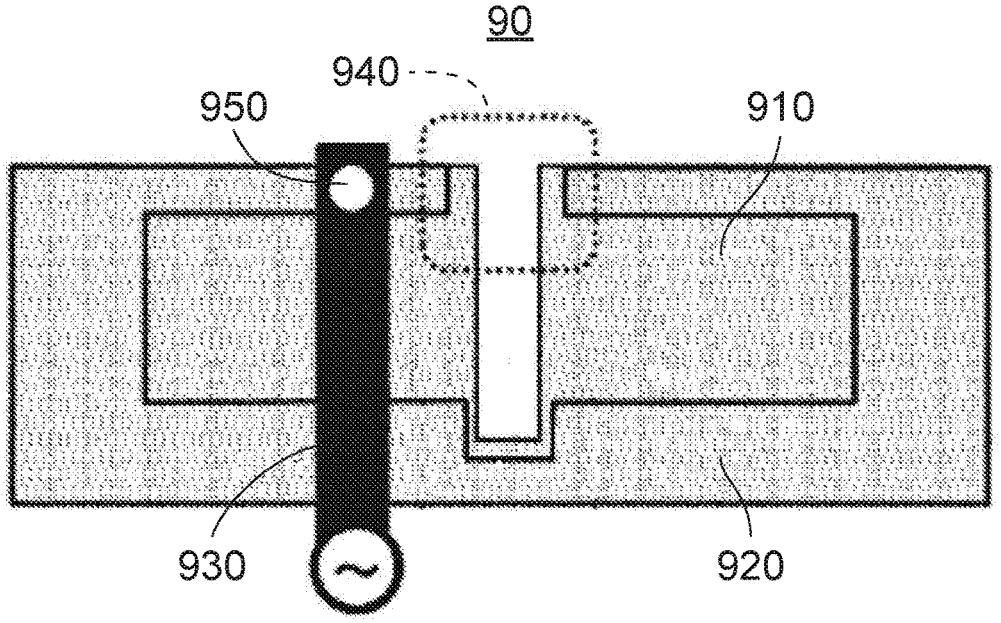
FIG. 16 PRIOR ART
FIG. 16 is a schematic structure view showing an antenna disclosed in Patent Document 1.

As shown in FIG. 13, the first extending portion 521A has a first rear end portion 535, and the second extending portion 523A has a second rear end portion 537. When the partly finished product 50A is produced, the first rear end portion 535 and the second rear end portion 537 are connected to a carrier 540 as shown in FIG. 15. The carrier 540 may be cut and eliminated after the partly finished product 50A is formed by cutting and bending a metal plate.

With reference to FIGS. 1, 11 and 12, the partly finished product 50A according to the present embodiment is mounted on a substrate 20 to form an antenna 10, similarly to the partly finished product 50 according to the first embodiment. In detail, with further reference to FIGS. 13 and 14, a first connected portion 351 of a first facing portion 32 is connected to a first end portion 227 at a first connected part 353 thereof when the partly finished product 50A is mounted on the substrate 20. Moreover, a second connected portion 391 of a second facing portion 36 is connected to a second end portion 229 at a second connected part 393 thereof. Furthermore, first fixed portions 355 of the first facing portion 32 are connected to first fixing portions 251 at lower ends of them, and second fixed portions 395 of the second facing portion 36 are connected to second fixing portions 253 at lower ends of them. After the partly finished product 50A is mounted on the substrate 20, the flat plate portion 525A of the joining portion 52A is cut off from the facing portion 30 by use of a first notch 531A and a second notch 533A which are formed in the first extending portion 521A and the second extending portion 523A, respectively. At this time, a part of the first extending portion 521A and a part of the second extending portion 523A become remaining portions which remain on the first facing portion 32 and the second facing portion 36, respectively. On ends of the remaining portions, snapped marks formed by snapping off the flat plate portion 525A remain. By snapping off the flat plate portion 525A, the first facing portion 32 of the facing portion 30 and the second facing portion 36 of the facing portion 30 are separated from each other. Then, the first facing portion 32 and the second facing portion 36 are apart from each other and face each other to form a capacitor. In this way, the antenna 10 in which the capacitor is connected to the first end portion 227 and the second end portion 229 is formed. Even when the partly finished product 50A of the present embodiment is used, effects similar to those of the first embodiment are obtained.

Although the specific explanation about the present invention is made above referring to the embodiments, the present invention is not limited thereto but susceptible of various modifications and alternative forms without departing from the spirit of the invention. For example, as the substrate 20, a double-sided substrate or a multilayer substrate may be used. Moreover, each of the first facing portion 32 and the second facing portion 36 may have a shape different from the shape in the aforementioned embodiments. As an example, the first facing portion 32 and the second facing portion 36 may be formed as comb shapes and arranged to form an interdigital structure.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. An antenna comprising an antenna main portion formed on a substrate and a facing portion separate and distinct from the substrate, wherein:

the antenna main portion has a ring shape with a split and has a first end portion and a second end portion which are located apart from each other in a lateral direction parallel with the substrate to form the split; and the facing portion has a first facing portion and a second facing portion which are made of conductive material and apart from each other, wherein:

the first facing portion has a first principal portion and a first connected portion which extends from the first principal portion and which is connected to the first end portion; and the second facing portion has a second principal portion facing the first principal portion and a second connected portion which extends from the second principal portion and which is connected to the second end portion.

2. The antenna as recited in claim 1, wherein:

the substrate is provided with a first fixing portion and a second fixing portion;

the first facing portion has a first fixed portion which extends from the first principal portion so as to be fixed to the first fixing portion; and the second facing portion has a second fixed portion which extends from the second principal portion so as to be fixed to the second fixing portion.

3. The antenna as recited in claim 1, wherein:

the first facing portion has a first remaining portion which extends from the first connected portion and which has a snapped mark at an end of the first remaining portion; and the second facing portion has a second remaining portion which extends from the second connected portion and which has a snapped mark at an end of the second remaining portion.

4. A partly finished antenna comprising a facing portion forming a capacitor to be mounted on a substrate, wherein:

the partly finished antenna is made of conductive material;

the partly finished antenna further comprises a joining portion;

the facing portion has a first facing portion and a second facing portion which are apart from each other;

the joining portion joins the first facing portion and the second facing portion to each other;

the first facing portion has a first principal portion and a first connected portion which extends from the first principal portion so as to be connected to a first end portion of an antenna main portion formed on the substrate;

the second facing portion has a second principal portion facing the first principal portion and a second connected portion which extends from the second principal portion so as to be connected to a second end portion of the antenna main portion;

the joining portion has a first extending portion extending from the first connected portion, a second extending portion extending from the second connected portion and a flat plate portion connecting the first extending portion and the second extending portion to each other;

the first connected portion is located between the first principal portion and the first extending portion;

the second connected portion is located between the second principal portion and the second extending portion; and when the facing portion is used, the facing portion is cut off from the flat plate portion at the first extending portion and the second extending portion.

5. The partly finished antenna as recited in claim 4, wherein the flat plate portion is used for suction and conveyance of the partly finished antenna.

6. The partly finished antenna as recited in claim 4, wherein the flat plate portion includes a position corresponding to a center of gravity of the partly finished antenna in a horizontal plane parallel with the first principal portion and the second principal portion.

7. The partly finished antenna as recited in claim 4, wherein:

the first extending portion and the second extending portion are formed with a first notch and a second notch, respectively; and the first extending portion and the second extending portion are snapped off and cut at the first notch and the second notch, respectively.

8. The partly finished antenna as recited in claim 7, wherein:

the first connected portion has a first connected part to be connected to the first end portion;

the second connected portion has a second connected part to be connected to the second end portion;

a distance from the first notch to the first connected part is shorter than a distance from the first principal portion to the first connected part; and a distance from the second notch to the second connected part is shorter than a distance from the second principal portion to the second connected part.

* * * * *